US011906275B2

(12) United States Patent
Muster et al.

(10) Patent No.: US 11,906,275 B2
(45) Date of Patent: Feb. 20, 2024

(54) BULLET, METHOD OF MANUFACTURING A BULLET, PUNCH FOR MANUFACTURING A BULLET, AND METHOD OF ROTATIONALLY SECURING A BULLET CORE WITH RESPECT TO A BULLET JACKET OF A BULLET

(71) Applicant: RUAG Ammotec AG, Thun (CH)

(72) Inventors: Michael Muster, Thun (CH); Markus Bucher, Wohlen bei Bern (CH); Donald Meyer, Grolley (CH)

(73) Assignee: RUAG Ammotec AG, Thun (CH)

( * ) Notice: Subject to any disclaimer, the term of this patent is extended or adjusted under 35 U.S.C. 154(b) by 0 days.

(21) Appl. No.: 17/632,326

(22) PCT Filed: Aug. 5, 2020

(86) PCT No.: PCT/EP2020/072036
§ 371 (c)(1),
(2) Date: Feb. 2, 2022

(87) PCT Pub. No.: WO2021/023785
PCT Pub. Date: Feb. 11, 2021

(65) Prior Publication Data

US 2022/0290957 A1 Sep. 15, 2022

(30) Foreign Application Priority Data

Aug. 5, 2019 (DE) ..... 10 2019 121 112.3

(51) Int. Cl.
*F42B 12/78* (2006.01)
*B21D 28/28* (2006.01)
*F42B 12/74* (2006.01)

(52) U.S. Cl.
CPC ..... *F42B 12/78* (2013.01); *B21D 28/28* (2013.01); *F42B 12/74* (2013.01)

(58) Field of Classification Search
CPC ..... F42B 12/78; F42B 12/74; B21D 28/28
(Continued)

(56) References Cited

U.S. PATENT DOCUMENTS 3,357,357 A * 12/1967 Voss ..... F42B 12/34 102/516
4,660,263 A 4/1987 Kosteck
(Continued)

FOREIGN PATENT DOCUMENTS

DE 19730968 A1 2/1998
DE 19600167 C1 7/2003
(Continued)

OTHER PUBLICATIONS

U.S. Pat. No. 3,767,28 A Brown published Jan. 17, 1888 (cited in ISR) (patent number will not be accepted in U.S. Patents field above).
(Continued)

*Primary Examiner* — Samir Abdosh
(74) *Attorney, Agent, or Firm* — FITCH, EVEN, TABIN & FLANNERY, LLP

(57) ABSTRACT

The present invention relates to a bullet, in particular precision bullet, comprising a bullet core with a bow-side section, a tail-side section with a bullet base and a guide band located therebetween, and a bullet jacket completely surrounding the bullet core, wherein in the region of the bullet core tail axially offset from the guide band and/or in the region of a tail-side end face of the bullet core base and/or in the region of the bullet core bow axially offset from the guide band a profiling is placed, in accordance with the bullet jacket, adapts complementary in shape in in such a way that an anti-rotation structure is formed between the bullet jacket and the bullet core.

19 Claims, 7 Drawing Sheets

Figure 2:
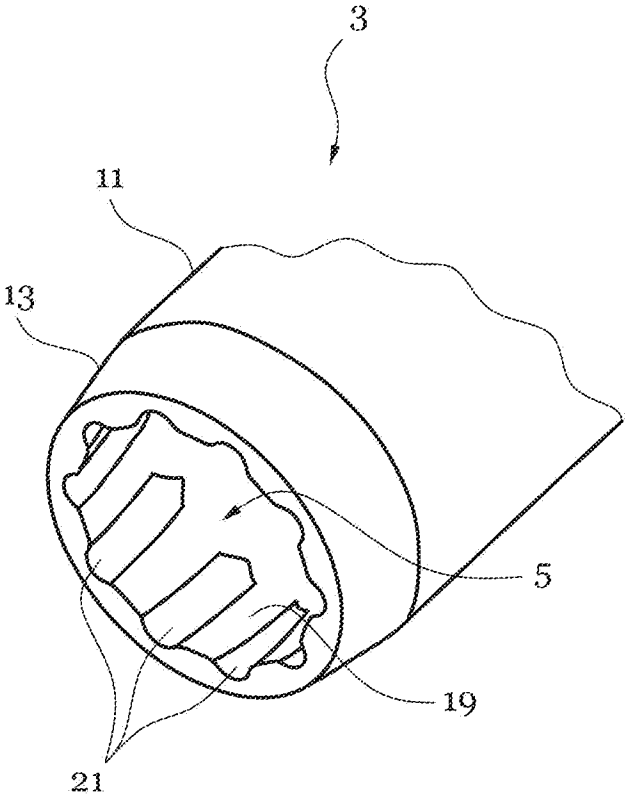

(58) Field of Classification Search
USPC ..... 102/513
See application file for complete search history.

(56) References Cited

U.S. PATENT DOCUMENTS

| | | | | |
|---|---|---|---|---|
| 4,731,189 | A * | 3/1988 | Gregg, Jr. | C10M 169/00 508/120 |
| 5,069,139 | A * | 12/1991 | Denis | F42B 12/78 102/516 |
| 6,305,293 | B1 * | 10/2001 | Fry | F42B 12/78 102/527 |
| 11,333,472 | B1 * | 5/2022 | Peterson | F42B 12/74 |
| 2007/0204758 | A1 * | 9/2007 | Spatz | F42B 12/78 102/514 |
| 2010/0175576 | A1 * | 7/2010 | Weeks | F42B 12/78 102/517 |
| 2016/0327380 | A1 * | 11/2016 | Kunz | F42B 10/44 |
| 2019/0017789 | A1 * | 1/2019 | Burczynski | F42B 12/74 |
| 2020/0248997 | A1 * | 8/2020 | McLaren | F42B 12/78 |
| 2020/0256654 | A1 * | 8/2020 | Burrow | C22C 1/0458 |
| 2020/0284560 | A1 * | 9/2020 | Tubb | F42B 10/44 |
| 2020/0363177 | A1 * | 11/2020 | Ruegsegger | F42B 5/025 |
| 2021/0341276 | A1 * | 11/2021 | Jones | F42B 33/001 |
| 2022/0178666 | A1 * | 6/2022 | Parker | F42B 12/78 |
| 2022/0349689 | A1 * | 11/2022 | Peterson | F42B 30/02 |

FOREIGN PATENT DOCUMENTS

| | | | | |
|---|---|---|---|---|
| DE | 10305721 | A1 | 9/2004 | |
| EP | 1186851 | A1 * | 3/2002 | F42B 12/78 |
| EP | 1664662 | A1 | 6/2006 | |
| FR | 2774162 | A1 | 7/1999 | |
| WO | WO-2004085953 | A1 * | 10/2004 | F42B 12/74 |
| WO | WO-2004085954 | A1 * | 10/2004 | F42B 12/74 |
| WO | WO-2014116950 | A1 * | 7/2014 | F42B 12/34 |

OTHER PUBLICATIONS

International Search Report for PCT/EP2020/072036 dated Oct. 23, 2020; 18 pages.

* cited by examiner

BULLET, METHOD OF MANUFACTURING A BULLET, PUNCH FOR MANUFACTURING A BULLET, AND METHOD OF ROTATIONALLY SECURING A BULLET CORE WITH RESPECT TO A BULLET JACKET OF A BULLET

CROSS-REFERENCE TO RELATED APPLICATIONS

This application is a U.S. national phase application filed under 35 U.S.C. § 371 of International Application No. PCT/EP2020/072036, filed Aug. 5, 2020, which claims priority from German Application No. DE 10 2019 121 112.3, filed Aug. 5, 2019, which are both incorporated herein by reference in their entireties.

The present invention relates to a bullet, in particular precision bullet. Furthermore, the present invention relates to a method for manufacturing a bullet. Moreover, the present invention provides a punch for manufacturing a bullet. Finally, the present invention provides a method for rotationally securing a bullet core with respect to a bullet jacket of a bullet.

In general, bullets are constructed as follows: a bullet core is arranged in a bullet jacket with a guide band for guiding the bullet core in the bullet jacket. When bullets are fired, in addition to an axial acceleration of the bullet head, a torque also acts on the bullet because it experiences angular momentum within the bullet jacket. It has been found that slip in the direction of rotation between the bullet core and the bullet jacket, i.e. a lack of form-locking, has a negative effect on the accuracy of the bullet. It has also been found that the lack of slip leads to uncontrolled torsion between the bullet core and jacket, which can cause fragmentation of the bullet resulting in deterioration of the bullet flight characteristics.

From U.S. Pat. No. 3,349,711 it is known to provide a protrusion-recess structure between the bullet jacket and the bullet core, which serves as a kind of anti-rotation structure to reduce the slip between the bullet core and the bullet jacket during firing and thus achieve improved precision of the bullet. In U.S. Pat. No. 3,349,711, however, it has been found to be disadvantageous that the protrusion-recess structure is formed in the guide band of the bullet causing weakening at the bullet jacket in the guide band. Due to the weakening of the guide band, the spin force occurring between the bullet core and bullet jacket cannot be sufficiently transmitted, so that the performance or precision of the bullet is impaired.

It is an objective of the present invention to improve the disadvantages of the known prior art, in particular to provide a bullet, preferably a precision bullet, with improved spin force transmission and/or improved precision.

The objective is solved by the present invention. According to one aspect of the present invention, a bullet, in particular precision bullet, is provided. Projectiles or bullets are part of a cartridge or ammunition of a firearm, in particular a gun. The bullet is that component of the cartridge which is fired by the firearm. A precision bullet can be understood as a bullet with an $S_a$-value of less than 40 mm. The determination of the $S_a$-value is described, for example, in the publication "Statistical measures of accuracy for riflemen and missile engineers" by Frank E. Grubbs, Ph. D. (Second Edition, March 1991; Third Printing, December 1991), the contents of which are incorporated herein by reference in their entirety.

The bullet, according to the invention, comprises a bullet core with a bow-side section, a tail-side section with a bullet base and a guide band lying inbetween, and a bullet jacket completely surrounding the bullet core. This means that the bow-side section and the tail section are axially offset with respect to the guide band in relation to the longitudinal direction of the bullet. In the region of the bullet core tail end axially offset from the guide band and/or in the region of a tail-side end face of the bullet core bow and/or in the region of the bullet core bow axially offset from the guide band, profiling can be worked according to which the bullet jacket adapts complementary in shape in such a way that an anti-rotation structure is formed between the bullet jacket and the bullet core. For example, the profiling in plan view can have an in particular full-circumference wave-like contour. It has been found in the present case that the guide band must be designed to be strong, in particular with the increasing performance of ammunition of firearms, this means that a weakening, such as a weakening of the material, of the guide band must be refrained from. Thus, on the one hand, it is ensured that an anti-rotation structure, in particular a form-locking anti-rotation structure, is formed. Thereby, the bullet core can be profiled with respect to the bullet jacket in such a way that the profiling realizes a form-locking between the bullet jacket and the bullet core. In an exemplary embodiment, the profiling is preferably notch-free and formed with a smooth profile transition, i.e., without sharp-edged transitions and/or profile jumps, along the profiling. It may be provided that the transitions along the profiling have as few and/or large radii as possible, preferably in the range of 0.1 mm to 0.5 * the wall thickness of the bullet jacket. According to a further exemplary development of the present invention, the profiling in the region of the bullet core tail and/or in the region of the bullet core bow extends along a predetermined axial length. In this respect, it can be ensured, on the one hand, that the profiling does not project into the region of the guide band. Furthermore, the profiling can be formed in such a way that it tapers off in one or both axial directions. This means that a depth in the radial direction, i.e., transverse to the axial direction of extension, decreases toward the axial ends of the profiling, preferably decreases continuously, in particular, to form a shoulder-free and/or profile-jump-free transition of the profiling into the corresponding bullet core circumferential surface or bullet jacket inner surface. It should be clear that the corresponding applies complementary in shape to the bullet jacket formed shape.

It may be provided that the guide band is free of any profiling. According to a further exemplary development of the present invention, the profiling comprises at least one latching element, such as a protrusion and/or a recess, which is associated with at least one latching element of the bullet jacket base, such as a recess and/or a protrusion, in such a way that the anti-rotation structure is formed. For example, the profiling comprises a plurality of preferably identical latching elements, wherein, for example, one protrusion and one recess each can alternate. In this way, a shaft profiling may be formed. For example, the tail end face of the bullet core base has a latching element, such as a protrusion and/or a recess. The latching element of the bullet core base may be associated with a latching element, such as a recess and/or a protrusion, made in an end face of the bullet jacket base facing the bullet core base end face, such that the anti-rotation structure is formed. The recess in the tail end face can be made, for example, by means of a forming punch.

In a further exemplary embodiment of the bullet according to the invention, a depth of a bullet base-side latching element in the longitudinal direction of the bullet is in the range from 1/10 mm to 1 mm, in particular in the range from 0.3 mm to 0.5 mm. Furthermore, it may be provided that a radial dimension of a bullet at the circumferential is substantially perpendicular to the longitudinal direction of the bullet latching element is in the range from 20% to 100%, preferably in the range from 40% to 80%, of the bullet base diameter and/or is in the range from 5% to 50% of a wall thickness of the bullet casing. By bullet circumferential side is meant, in particular, circumferential sides of the bullet core tail and/or bullet core bow as well as corresponding circumferential sides of the bullet jacket inner side. It has been found in accordance with the present invention that such small dimensions of the latching elements are already sufficient to achieve a beneficial effect with respect to the transmission of the spin force and thus the precision of the bullet. In particular, the latching elements serve to transmit a spin force or torque when the bullet is fired by means of a firearm, and in particular to prevent slippage between the bullet jacket and the bullet core.

In a further exemplary further development of the bullet according to the invention, the latching elements, in particular, the latching elements at the bullet base core and/or the bullet base jacket, have a cross, star or polygonal shape. These geometric shapes have proved to be particularly advantageous with regard to the transmission of spin force. According to another aspect of the present invention, a bullet, in particular precision bullet, is provided. Projectiles or bullets are part of a cartridge or ammunition of a firearm, in particular a handgun. The bullet is that component of the cartridge that is fired by the firearm. A precision bullet can be understood as a bullet with an $S_a$-value of less than 40 mm. The determination of the $S_a$-value is described, for example, in the publication "Statistical measures of accuracy for riflemen and missile engineers" by Frank E. Grubbs, Ph. D. (Second Edition, March 1991; Third Printing, December 1991), the contents of which are incorporated herein by reference in their entirety.

The bullet comprises a bullet jacket having an inner surface. The inner surface may face a cavity bounded by the bullet jacket. The bullet jacket may be made of, for example, steel, lead, copper, or alloys thereof, and may be enriched with, for example, uranium or tungsten. In particular, the bullet jacket may be made of a lead-free material to meet increasing demands for contaminant-free ammunition.

The bullet further comprises a bullet core disposed within the bullet jacket, which may also be made of steel, lead, copper, or alloys thereof, for example, and may be lead-free. The bullet core includes a guide band for guiding the bullet core within the bullet jacket.

The guide band may, for example, perform internal ballistic tasks. An outer surface of the guide band at least partially lies against the bullet jacket inner surface, in particular, to provide axial guidance of the bullet core within the bullet jacket. The guide band is generally arranged in the region axially between the bullet core tail and bullet core bow, where bow or tail is to be understood in relation to the firing direction of the firearm. The guide band may have an at least partially substantially cylindrical outer contour and/or may merge continuously into the bullet core bow and/or the bullet core tail, preferably without a shoulder or edge.

In accordance with the aspect of the present invention, at least one of the bullet jacket inner surfaces lying against each other and guide band outer surface has a roughness in the range of 0.0005 mm to preferably 0.5 mm at least in areas, where area may be understood to mean in the axial direction and/or radial direction, to form an anti-rotation structure between the bullet jacket and the bullet core. The roughness may be defined, for example, by the average surface roughness $R_a$. Preferably, the roughness is in the range from 0.001 mm to preferably 0.09 mm, in particular in the range from 0.002 to preferably 0.08 mm, in particular in the range from mm to preferably 0.07 mm, in particular in the range from 0.004 mm to preferably 0.06 mm, in particular in the range from 0.005 mm to preferably 0.05 mm. For example, the anti-rotation structure is implemented by a frictional/force-locking connection between the bullet core and the bullet jacket inner surface. The surface roughness of the bullet jacket and/or guide band in some areas may increase a normal force acting between the bullet jacket inner surface and the outer surface of the guide band, which forms a static frictional force between the bullet jacket and the bullet core that prevents unwanted rotation of the bullet core relative to the bullet jacket. In accordance with the present invention, it has been found that the formation of a certain surface roughness in the range of 0.0005 mm to preferably 0.5 mm has a beneficial effect on the spin force transmission due to the frictional-/force locking between the bullet jacket and the bullet core, and the precision of the bullet is thus significantly improved. With the bullet according to the invention, $S_a$-values of less than 30 mm, preferably less than 20 mm or even less than 15 mm, can be achieved. For example, the bullet jacket inner surface is provided with the roughness according to the invention. This may be due to the fact that usually the jacket is harder/stiffer than the core, preferably made of a harder/stiffer material than the core, for example of tombac and the core for example of lead. In exemplary embodiments, so-called hard core bullets, the core is made of a harder material than the jacket, so that in this case advantageously the bullet core has the roughness according to the invention. It has been found that, for example, by manual or mechanical surface treatment of, for example, the bullet jacket inner surface with a wire brush having a wire thickness of 0.08 to 0.1 mm, advantageous results could be achieved, in particular with regard to an improvement in precision.

In an exemplary embodiment of the bullet according to the invention, both the bullet jacket inner surface and the outer surface of the guide band have a roughness in the range from 0.0005 mm to preferably 0.5 mm, in particular in the range from 0.005 mm to preferably 0.05 mm, at least in some areas, in particular completely. As a result, the effect of improved spin force transmission and improved precision according to the invention could be further enhanced. A further advantageous measure consists in the fact that the region of the specific surface roughness of the bullet jacket inner surface faces the region of the specific surface roughness of the guide band outer surface and/or is at least partially overlapped therewith, in particular is completely congruent.

According to a further exemplary development of the bullet according to the invention, the bullet jacket is formed from a metal strip, in particular deep-drawn. The metal strip has a roughness in the range from 0.005 mm to preferably 0.05 mm, at least in some areas. Thus, for example, the metal strip can be pre-processed and/or treated in its raw form in such a way that it has the specific surface roughness at least in certain areas. According to a further aspect of the present invention, which can be combined with the preceding aspects and exemplary embodiments, a bullet, in particular precision bullet, is provided. Projectiles or bullets are part of a cartridge or ammunition of a firearm, in particular a handgun. The bullet is that component of the cartridge that is fired by the firearm. A precision bullet can be understood as a bullet with an $S_a$-value of less than 40 mm. The determination of the $S_a$-value is described, for example, in the publication "Statistical measures of accuracy for riflemen and missile engineers" by Frank E. Grubbs, Ph. D. (Second Edition, March 1991; Third Printing, December 1991), the contents of which are incorporated herein by reference in their entirety.

The bullet comprises a bullet jacket having an inner surface. The inner surface may face a cavity bounded by the bullet jacket. The bullet jacket may be made of, for example, steel, lead, copper, or alloys thereof, and may be enriched with, for example, uranium or tungsten. In particular, the bullet jacket may be made of a lead-free material to meet increasing demands for contaminant-free ammunition.

The bullet further comprises a bullet core disposed within the bullet jacket, which may also be made of steel, lead, copper, or alloys thereof, for example, and may be lead-free. The bullet core includes a guide band for guiding the bullet core within the bullet jacket. The guide band can, for example, perform internal ballistic tasks.

According to the further aspect of the present invention, a bullet jacket inner dimension is matched to a guide band outer dimension such that an interference fit, preferably a press-fit, is realized. For example, a radial oversize dimension measured perpendicular to the longitudinal direction of the bullet is in the range of 0.0001 mm to preferably 0.1 mm, more preferably in the range of 0.001 mm to 0.01 mm. It has been found that by means of the interference fit, a frictional/force-locking anti-rotation structure can be realized between the bullet jacket and the bullet core, which increases a spin force transmission and thus improves the precision of the bullet. For example, the bullet core, which may be made of lead, hardened steel or tungsten carbide, is inserted into the bullet jacket by a pressing process and pressed together with the jacket. With the bullet according to the invention, $S_a$-values of less than 30 mm, preferably less than 20 mm or even less than 15 mm, can be achieved. The interference fit can be achieved, for example, by separate manufacture of the bullet core and bullet jacket.

According to a further exemplary development, the radial oversize is in the range of 0.001 mm to preferably 0.01 mm.

In another exemplary embodiment of the present invention, the bullet is mounted under temperature treatment. For example, the preferably oversized bullet core is mounted with the bullet jacket under temperature cooling. Alternatively or additionally, the preferably undersized bullet jacket may be mounted with the bullet core under temperature heating. It has been found that by means of the temperature treatment, on the one hand, the mounting of the bullet according to the invention is facilitated and, on the other hand, the radial interference meanwhile bullet core and bullet jacket can be reinforced, thus enhancing the inventive effect of improved spin force transmission and increased precision of the bullet. When the temperatures of the bullet core and bullet jacket are equalized, i.e. when the bullet core is continuously heated and/or when the bullet jacket is continuously cooled, the frictional/force-locking anti-rotation structure between the bullet jacket and bullet core is then realized.

In another exemplary embodiment of the bullet according to the invention, a bullet jacket inner surface and/or a guide band outer surface is/are profiled in such a way that leakage flow of a fluid accumulating in the bullet between the bullet jacket and the bullet core is enabled. It has been found that when there is an interference fit between the bullet jacket and bullet core for mounting, any lubricant or air in the bullet jacket that may be required can no longer be discharged outwardly from the bullet jacket because the interference fit seals the bullet jacket from the bullet core. It can therefore be advantageous to allow leakage flow by profiling the bullet jacket inner surface and/or the outer surface of the guide band in order to allow any lubricant or air to escape.

According to a further exemplary embodiment of the present invention, the bullet core has a through bore for fluid leakage flow. Alternatively, or additionally, the bullet core may be shaped such that at least one guide band outer surface region formed substantially along the full longitudinal extent of the bullet core is free from contact with the bullet jacket inner surface. For example, this may be by a rectilinear or curved groove, preferably helical, provided on the guide band, thereby forming a leakage flow channel for the fluid. For example, it may be provided that the bullet core is segmented and/or polygonal in cross-section, preferably in the region of the guide band. In other words, the leakage flow can be achieved by the bullet core, in particular the guide band, not being completely complementary in shape with respect to the bullet jacket inner surface. The segmenting and/or shaping of the bullet core can be realized, for example, by a solid forming process.

According to a further aspect of the present invention, which can be combined with the preceding aspects and exemplary embodiments, a bullet, in particular precision bullet, is provided. Projectiles or bullets are part of a cartridge or ammunition of a firearm, in particular a handgun. The bullet is that component of the cartridge that is fired by the firearm. A precision bullet can be understood as a bullet with an $S_a$-value of less than 40 mm. The determination of the $S_a$-value is described, for example, in the publication "Statistical measures of accuracy for riflemen and missile engineers" by Frank E. Grubbs, Ph. D. (Second Edition, March 1991; Third Printing, December 1991), the contents of which are incorporated herein by reference in their entirety.

The bullet comprises a bullet jacket having an inner surface. The inner surface may face a cavity bounded by the bullet jacket. The bullet jacket may be made of, for example, steel, lead, copper, or alloys thereof and may be enriched with, for example, uranium or tungsten. In particular, the bullet jacket may be made of a lead-free material to meet increasing demands for contaminant-free ammunition.

The bullet further comprises a bullet core disposed within the bullet jacket, which may also be made of steel, lead, copper, or alloys thereof, for example, and may be lead-free. The bullet core includes a guide band for guiding the bullet core within the bullet jacket. The guide band can, for example, perform internal ballistic tasks.

According to a further aspect of the present invention, a solidification fluid and/or an additive that increases the coefficient of friction between the bullet jacket and the bullet core is applied to the bullet jacket and/or the bullet core in the region of the guide band, which fluid forms an anti-rotation structure between the bullet jacket and the bullet core. The term "solidification fluid" is used in this context to mean a flowable medium and/or a fluid that produces an integral bonding between the bullet jacket and the bullet core, preferably by means of atomic or molecular forces. The integral bonding that is realized between the bullet jacket and the bullet core can prevent relative rotation with respect to one another in order to increase the precision of the bullet. For example, a solidification fluid can be characterized by the fact that it changes its chemical property over time and, for example, increasingly forms a kind of adhesive property that realizes an integral bonding between the bullet core and bullet jacket. In this context, the solidification fluid can be defined in such a way that it has a different toughness/strength in an unbuilt, original state than in the installed state in the bullet according to the invention. The solidification or change in properties of the solidification fluid may be caused and/or accelerated by heat treatment, aging processes due to storage, and/or external pressure. Alternatively, or additionally, the additive increases the coefficient of friction and can be introduced between the bullet jacket and the bullet core, preferably in the region of the guide band, in order to prevent the resistance to spin of the bullet core relative to the bullet jacket caused by friction, in particular in order to increase the static frictional force between the bullet core and the bullet jacket. In particular, this increases the self-locking effect of the bullet. For example, sand or similar particles can be used as an additive. Furthermore, it is possible to introduce a suspension, i.e. a heterogeneous mixture of liquid and particles, between the bullet jacket and the bullet core, and/or to apply the suspension to the outside of the guide band already during manufacture of the bullet core. The additive thus represents a further possibility according to the invention of forming the anti-rotation structure by means of a frictional/force-locking between the bullet core and the bullet jacket.

According to a further exemplary development of the bullet according to the invention, the solidification fluid is a precipitable solution, such as synthetic oil, bitumen, olive oil, sugar containing liquid or an adhesive. Precipitation as used herein refers to the precipitation of a solute from a solution. This occurs by exceeding the solubility of the solute due to changes in environmental conditions and occurs as, for example, crystallization, such as polymerization. For example, a bitumen coating can form a quasi-solute bond between the bullet jacket and bullet core that acts as an anti-rotation structure. The use of olive oil has been found to be advantageous, first, in that it acts as a kind of lubricant during assembly of the bullet core into the bullet jacket, which is particularly beneficial to assembly when the bullet core is oversize with respect to the bullet jacket. On the other hand, it has been found that the olive oil located and/or accumulating in the area between the bullet core and the bullet jacket dries out over time, resulting in crystallization (polymerization) of the olive oil, which forms a glue-like bond between the bullet core and the bullet jacket that provides anti-rotation structure to increase the transmission of the spin force and improve the precision of the bullet.

According to a further exemplary embodiment of the present invention, an amount of the solidification fluid is in the range of 2 ml to preferably 6 ml.

In another exemplary embodiment of the present invention, the bullet core is pinned with respect to the bullet jacket in the tail region of the bullet. This kind of anti-rotation structure has proven to be an effective and structurally simple measure, particularly for medium and large calibers. Another advantage of this kind of anti-rotation structure is that existing bullets can be retrofitted with an anti-rotation structure as an upgrade. The pinned fitting is designed to connect the bullet core and the bullet jacket. For example, at least two locking pins are provided that project into at least two openings made in the bullet core base face. In particular, the at least two locking pins project into the bullet core by at least 0.2 times to 0.8 times the diameter of the bullet. Furthermore, it may be provided that a diameter of the at least two locking pins is approximately 0.05 times to 0.2 times, preferably 0.07-times to 0.015 times, the bullet diameter. This ensures successful transmission of the spin force to form the anti-rotation structure between the bullet jacket and the bullet core.

In a further exemplary further development of the bullet according to the invention, the tail region of the bullet jacket is designed to be rich in deformation in such a way that a firing pressure occurring during firing of the bullet deforms the tail region of the bullet jacket, at least in sections, in such a way that it adapts to the preferably rigid bullet core in order to form, preferably reinforce, an anti-rotation structure between the bullet jacket and the bullet core. In accordance with the present invention, it has been found that preferably the firing pressure alone can be utilized to form the anti-rotation structure. In this regard, no further design and/or manufacturing measures are necessary to achieve the inventive effect of improved spin force transmission and improved accuracy.

According to an exemplary embodiment of the present invention, it may be provided that the bullet core is joined to the bullet jacket by a friction welding, diffusion welding or spot-welding process. In the friction welding process, the bullet core and the bullet jacket are moved relative to each other under pressure, with the bullet core and the bullet jacket contacting each other at the contact surfaces that are welded together. The resulting friction causes the contact surfaces to heat up and the bullet core material and/or the bullet jacket material to plasticize at specific points. The joining of the bullet jacket and bullet core then takes place under the application of external pressure. One possibility for spot welding of the bullet core and bullet jacket is shadow welding.

In a further exemplary embodiment of the present invention, the bullet jacket inner surface and the outer surface of the bullet core, in particular the outer surface of the guide band, are form-locking with each other by means of a repeating protrusion-recess structure in such a way that relative rotational mobility between the bullet jacket and the bullet core is prevented, in particular the anti-rotation structure is formed. The protrusion-recess structure comprises at least two protrusions on at least one of the bullet jacket inner surface and bullet core outer surface and at least two recesses, in particular complementary in shape, on at least the other of the bullet jacket inner surface and bullet core outer surface. It may be provided that the protrusions and the recess have a radial extension of at least 1/20 and at most 1/5 of the bullet core diameter. It has been found that even the slight dimensions of the protrusion-recess structure provide sufficient anti-rotation structure to produce a significant improvement in spin force transmission and accuracy.

In another exemplary embodiment of the bullet according to the invention, the anti-rotation structure allows relative axial movement between the bullet jacket and the bullet core, in particular to a certain axial movement clearance.

Segmentation of the tail end of the bullet jacket is another option for preventing spin. During the manufacturing process of the bullet jacket in the bullet jacket, for example, a segmentation is introduced at least axially in sections into the bullet jacket from the inside and/or from the outside by means of a solid forming process.

Furthermore, the anti-rotation structure can be achieved by segmenting the bullet core. Segmentation of the bullet core can be advantageous, particularly in the case of a hard bullet core, especially when used for penetration ammunition. The bullet core should be designed in such a way that it cuts into the bullet jacket as a result of the firing of the bullet i.e., as a result of the firing pressure acting on the bullet, and thus generates a form-lock between the bullet jacket and the bullet core.

According to a further aspect of the present invention, which may be combined with the previous aspects and exemplary embodiments, there is provided a method of manufacturing a bullet, in particular precision bullet, formed according to any of the previously described aspects or exemplary embodiments, respectively. The bullet jacket may be produced, for example, by deep-drawing using a punch-die arrangement. In this regard, the punch may be segmented at least in axial sections, for example to form the protrusion-recess structure on the bullet jacket inner surface, wherein the punch presses into the bullet jacket inner surface such that the protrusion-recess structure is formed. The segmentation of the punch can be realized, for example, by a solid forming process to form the outer contour of the punch at least in sections, which is then responsible for the protrusion-recess structure of the bullet jacket.

In another aspect of the present invention, combinable with the preceding aspects and exemplary embodiments, there is produced a punch for producing a bullet, in particular precision bullet, realized according to any of the exemplary previously described aspects and/or exemplary embodiments.

According to a further aspect of the present invention, which can be combined with the preceding aspects and exemplary embodiments, there is provided a method for rotationally securing a bullet core with respect to a bullet jacket of a bullet, in particular precision bullet, formed in particular according to one of the preceding aspects and/or exemplary embodiments. In the method according to the invention, at least two locking pins are inserted from the outside into a tail-side bullet base in such a way that the at least two locking pins extend through a bullet jacket end face forming the bullet base and a bullet core base end face facing the bullet jacket end face to form an anti-rotation structure. It has been found that in this way existing base can be retrofitted, in particular upgraded, in a simple and inexpensive manner to form base with an anti-rotation structure.

According to a further exemplary development of the method according to the invention, before the insertion of the at least two locking pins in the bullet base, a bore is made in each case for the locking pins, wherein in particular an inner diameter of the bores is dimensioned smaller than an outer diameter of the locking pins and/or the locking pins are pressed in the bores, in particular have a radial oversize with respect to the bores. Preferred embodiments are given in the subclaims.

Figure 1:
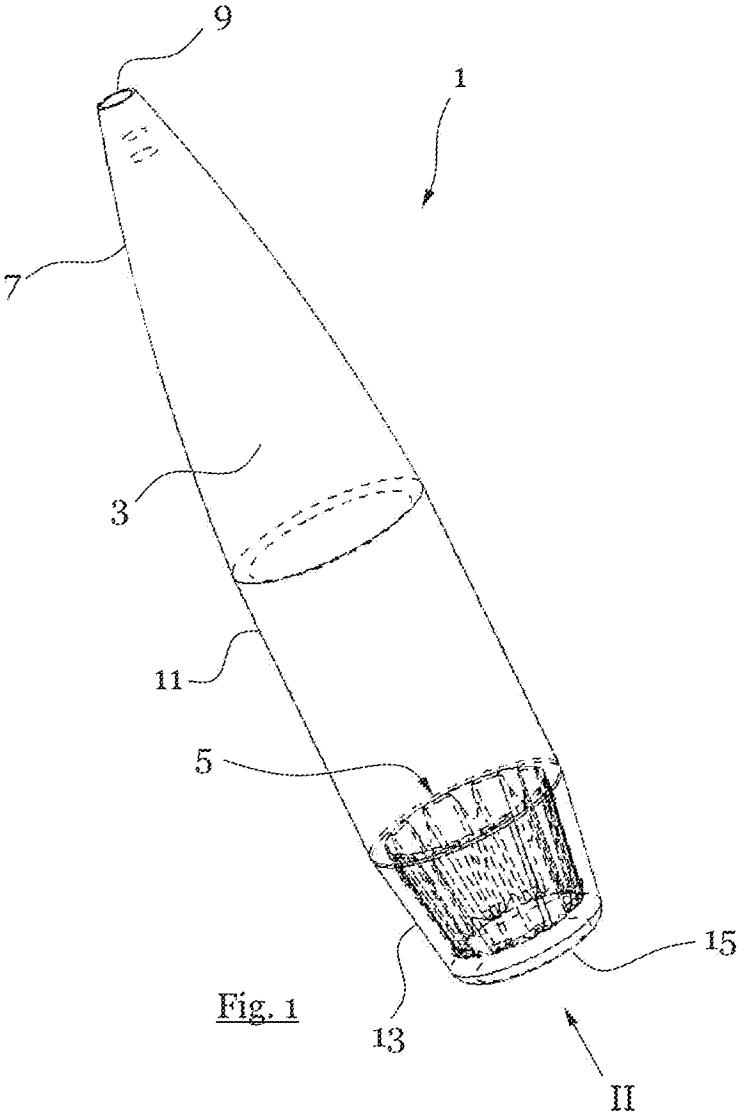
Figure 4:
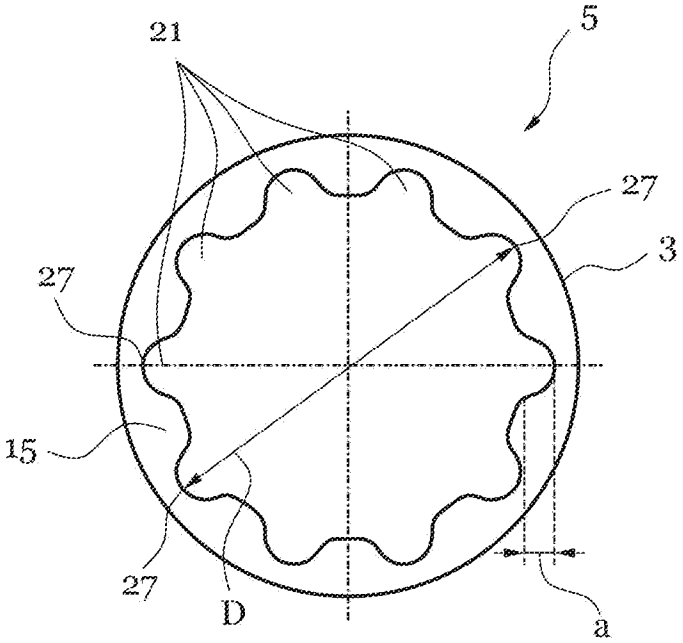
Figure 3:
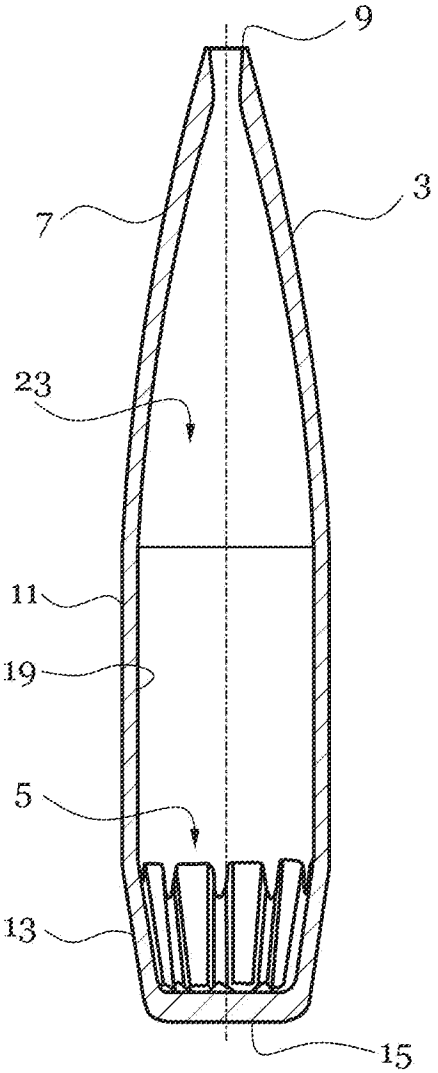
Figure 6:
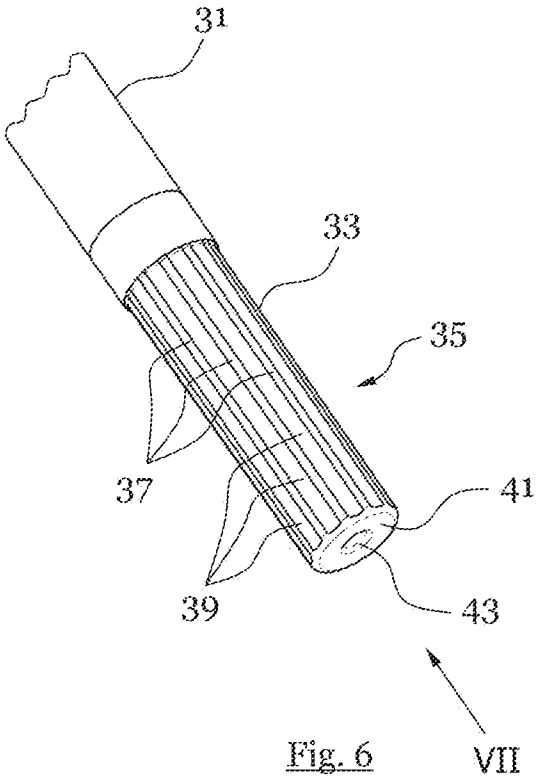
Figure 5:
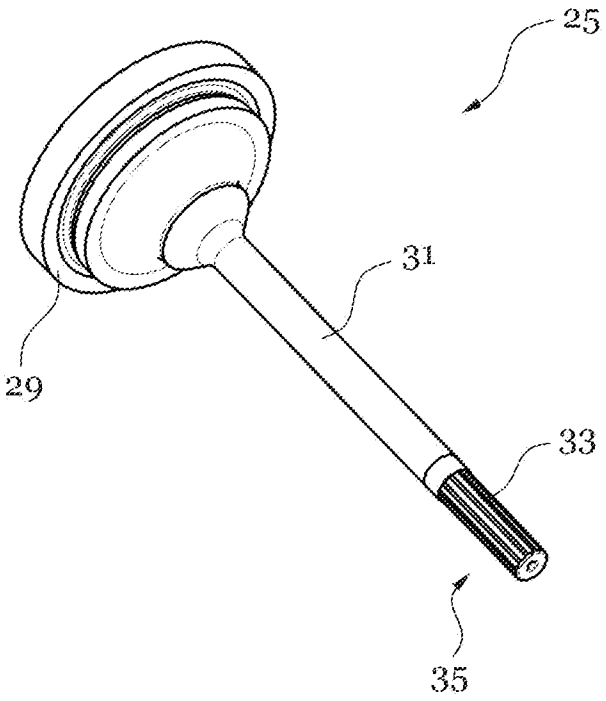
Figure 8:
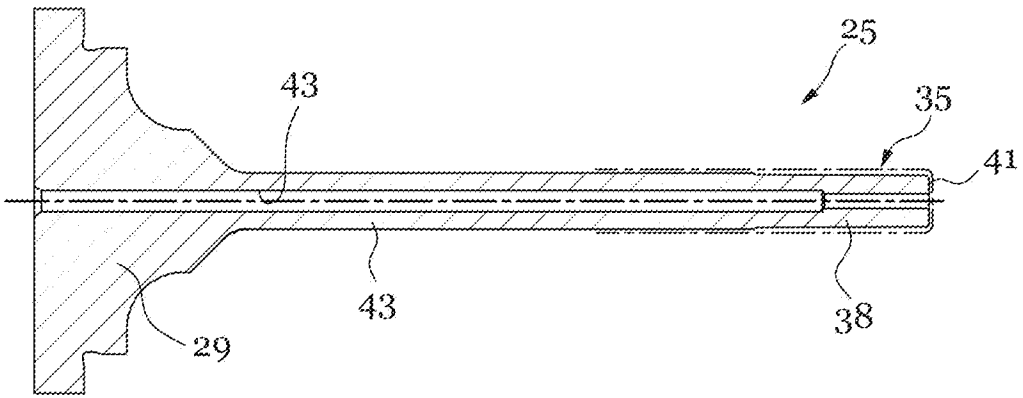
Figure 7:
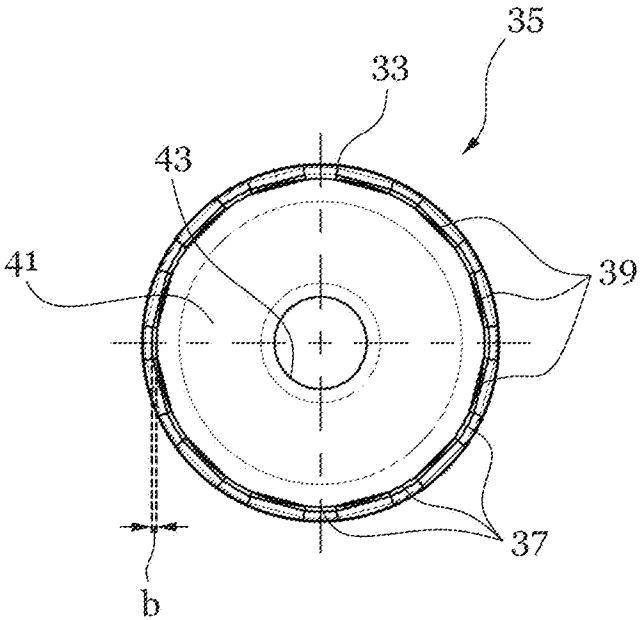
Figure 9:
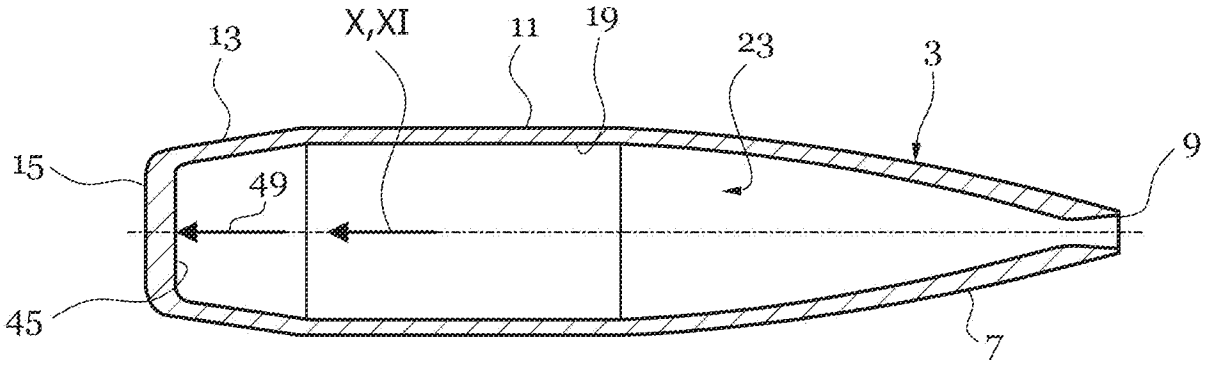
Figure 11:
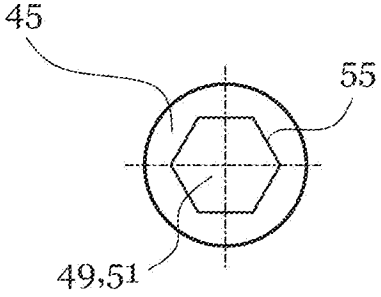
Figure 10:
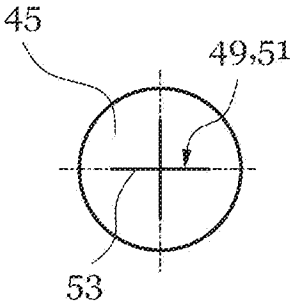
Figure 12:
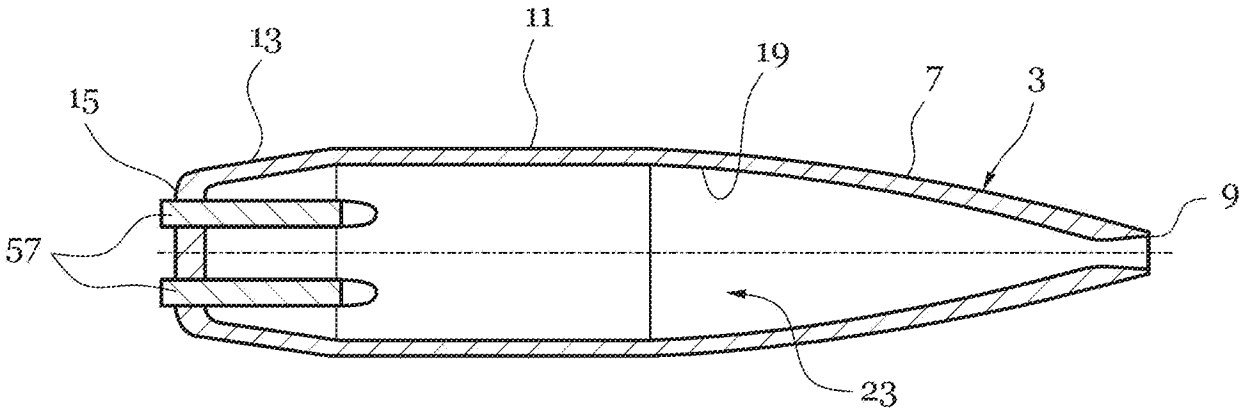
Figure 13:
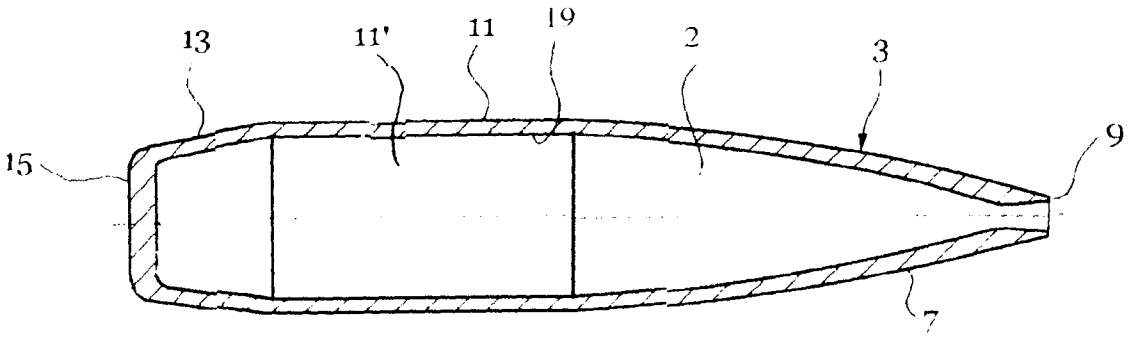

In the following, further properties, features and advantages of the invention will become clear by means of a description of preferred embodiments of the invention with reference to the accompanying exemplary drawings, in which show:

FIG. 1 a perspective view of a bullet jacket of a bullet according to the invention;

FIG. 2 a detailed perspective view of a tail section of the bullet jacket according to FIG. 1 as shown by arrow II;

FIG. 3 a sectional view of the bullet jacket according to FIG. 1;

FIG. 4 a bottom view of the bullet jacket according to FIGS. 1 to 3;

FIG. 5 a perspective view of a punch according to the invention;

FIG. 6 a detailed view of the punch according to FIG. 5;

FIG. 7 a plan view of the punch according to arrow VII of FIG. 6;

FIG. 8 a sectional view of the punch according to FIG. 5;

FIG. 9 a sectional view of a further exemplary design of a bullet jacket of a bullet according to the invention;

FIG. 10 a schematic plan view of a bullet jacket base according to arrow X in FIG. 9;

FIG. 11 another exemplary schematic view of a bullet jacket base according to arrow XI of FIG. 9; and FIG. 12 a sectional view of a further exemplary embodiment of a bullet jacket of a bullet according to the invention; and FIG. 13 a sectional view of a further exemplary embodiment of a bullet according to the invention.

In the following description of exemplary embodiments of a bullet according to the invention, in particular precision bullet, a bullet according to the invention is generally provided with the reference numeral 1, consisting substantially of a bullet jacket 3 and a bullet core arranged within the bullet jacket 3, which is not illustrated for reasons of clarity. As illustrated in the figures, exemplary embodiments of a bullet 1 may also be referred to as precision bullets characterized by an $S_a$-value of less than 30 mm, preferably less than 20 mm or even less than 15 mm. With the aid of the exemplary embodiments of bullets 1, the measures according to the invention for increasing the transmission of spin force between the bullet jacket 3 and the bullet core (not shown) or for increasing the precision of bullets 1 are described.

With reference to FIGS. 1 to 4, a first embodiment of a bullet 1 according to the invention is described. FIG. 1 shows a perspective view of the bullet jacket 3, which has an engagement structure 5 for forming a form-locking anti-rotation structure between the bullet jacket 3 and the bullet core. The bullet jacket 3 comprises a bow section 7 extending from a bullet bow 9 to a guide band 11 adjoining the bow section 7 in the longitudinal direction of the bullet. Starting from the guide band 11, the bow section 7 has a cross-section which tapers increasingly towards the bullet tip 9 and whose basic shape is circular. According to FIG. 1, the guide band 11 is shaped as a substantially cylindrical section with a constant outer diameter. Opposite the bow section 7, the guide band 11 opens into a bullet tail section 13 which extends to a bullet base 15 opposite the bullet tip 9. The bullet tail 13 also has a circular cross-section whose outer dimension decreases substantially continuously toward the bullet base 15.

With reference to FIG. 2, the bullet jacket tail 13 and in particular the engagement structure 5 are shown in more detail, whereby that part of the bullet jacket tail 13 which opens into the bullet jacket base 15 is not shown, in particular has been cut away. As can be seen in particular from a synopsis of FIGS. 1 and 2, the engagement structure 5 is implemented substantially in the region of the bullet jacket tail 13. The engagement structure 5 is formed on a bullet jacket inner surface 19. The engagement structure 5 comprises a plurality of recesses 21 formed on the bullet jacket inner surface 19 and arranged at a continuous distance from each other, distributed circumferentially on the bullet jacket inner surface 19, which recesses extend from the bullet jacket base 15 in the longitudinal direction of the bullet for example along the complete axial extension of the bullet jacket tail section 13.

FIG. 3 shows a sectional view of the bullet jacket 3. It can be seen that the bullet jacket 3 is open to the surroundings at the bullet tip 9. The bullet jacket 3 comprises a substantially constant wall thickness without limitation in its interior a cavity 23 into which the bullet core (not shown) is to be inserted. In order to implement the anti-rotation structure between the bullet jacket 3 and the bullet core (not shown), the bullet core also has, on an outer surface facing the bullet jacket inner surface 19, an engagement structure which is form-locking with the engagement structure 5 of the bullet jacket 3 in such a way that relative rotational mobility between the bullet jacket 3 and the bullet core is prevented. According to the exemplary embodiment shown in FIG. 3, according to which the engagement structure 5 of the bullet jacket 3 is formed as a repeating recessed structure 21, the engagement structure of the bullet core is shaped as a repeating protrusion structure, the protrusions each form-locking engaging or projecting into a recess 21 of the engagement structure 5.

In FIG. 4 the engagement structure 5 of the bullet jacket 3 is shown in plan view. In FIG. 4 it is schematically indicated that a radial extension of the depressions 21, as well as also of the protrusions (not shown) of the engagement structure of the bullet core, of at least 1/20 and at most 1/5 of the bullet core diameter possess. The bullet core diameter D may be dimensioned from a bottom 27 of the recess 21 to a bottom 27 of the opposite recess 21, as schematically indicated in FIG. 4.

With reference to FIGS. 5 to 8, an exemplary embodiment of a punch 25 according to the invention for producing a bullet 1 according to the invention is described, by means of which the bullet 1 according to the invention, or the bullet jacket 3 of a bullet 1 according to the invention, can be produced by means of a deep-drawing process. According to the present invention, other manufacturing processes, in particular tensile pressure forming processes, can also be used to produce the bullet jacket 3 or the bullet 1. The punch 25 comprises a base section 29, which for example is shaped in a rotational form, and an extension section 31, which is arranged coaxially to the base section 29 and which for example is also shaped in a rotational form, such as cylindrical. Towards its end, the extension section 31 opens into a shaping section 33 which, for example, accounts for 25% to 50% of the axial longitudinal extent of the extension section 31. The shaping section 33 comprises a circumferentially provided profiling 35. The circumferential profiling 35 of the shaping section 33 can be manufactured, for example, by means of a solid forming process.

FIGS. 6 and 7 show the profiling 35 enlarged. The profiling 35 may comprise alternating bump 37 and dimple 39 in the circumferential direction of the shaping section 35, the longitudinal extent of which is equally dimensioned. To form the engagement structure 5 on the bullet jacket 3, the punch 25 is pressed into the inside space 23 of the bullet jacket 3. In particular, the shaping section 33 is pressed against a bullet jacket inner surface 19, for example in the region of the bullet jacket tail section 13. As a result, a negative contour of the profiling 35 can be formed on the bullet jacket inner surface 19, which represents the engagement structure 5 for the bullet core. An axial length of the engagement structure 5 within the bullet jacket 3 can be set via an axial length of the shaping section 33, in particular of the profiling 35. A front end 41, into which the shaping section 33 merges, is formed by a substantially flat surface, which preferably comprises in its center a passage channel 43, which, as can be seen in FIG. 8, extends through the complete longitudinal extent of the punch 25.

FIG. 7 shows a face view of the front end 41 of the punch 25 as shown by arrow VII of FIG. 6, with the base section 29 omitted. In FIG. 7, the rotational geometry of the profiling 35 and the shaping section 33 can be seen. It can also be seen that the dimple 39 have a larger circumferential dimension than the bump 37, each of which is arranged between two adjacent dimple 39. The radial depth of the engagement structure 5 in the bullet jacket 3 can be adjusted by means of a radial extension b of the bump 37 or dimple 39. According to FIG. 8, it can be seen that the punch is substantially made of solid material and that the passage channel 43 runs in its center of rotation.

With reference to FIGS. 9 to 12, further exemplary embodiments of a bullet jacket 3 of a bullet 1 according to the invention are described. In order to avoid repetition, substantially only the differences arising with respect to the preceding embodiments will be described below. The bullet jacket 3 according to FIG. 9 differs from the bullet jacket of FIGS. 1 to 4 substantially in that no engagement structure 5 is provided in the region of the bullet jacket tail section 13. In order to form the anti-rotation structure between the bullet jacket 3 and the bullet core, profiling 49 is formed on a tail end face 45 in the inside space 23 of the bullet jacket 3 in accordance with which the bullet core adapts in a complementary manner in such a way that the anti-rotation structure is formed.

FIGS. 10 and 11 show two exemplary embodiments of a tail end face profiling 49. In both FIG. 10 and FIG. 11, the profiling 49 in the tail end face 45 is formed as a latching element 51, which is associated with a correspondingly formed, preferably a complementary in shape, latching element of the bullet core and can engage with the latter in order to realize a transmission of spin force and thus an anti-rotation structure. In FIG. 10, the latching element 51 is shaped as a star-shaped locking protrusion or star-shaped locking recess 53 which cooperates, for example, with a star-shaped locking recess or locking protrusion on the tail end face of the bullet core base. In FIG. 11, the latching element 51 is realized as a polygonal protrusion 55 or polygonal recess 55, in particular hexagonal recess or hexagonal protrusion, which cooperates with a shape-complementary latching element of the tail end face of the bullet core base to form the anti-rotation structure. Advantageously, a depth of the latching elements 51 in the longitudinal direction of the bullet is in the range of 1/10 mm to 10/10 mm. Furthermore, a radial dimension substantially perpendicular to the longitudinal of the latching elements direction of the bullet should be in the range of 20% to 100%, preferably in the range of 40% to 80% of the bullet base diameter.

The exemplary embodiment of the bullet jacket 3 according to FIG. 12 differs from the previously described embodiments in that neither an engagement structure 5 according to FIGS. 1 to 4, nor a tail end face profiling 49 according to FIGS. 9 to 11 is provided. In FIG. 12, the bullet core, which is not shown, is pinned with respect to the bullet jacket 3 in the tail section 13 of the bullet 1. The pinned fitting is realized by means of at least two pins 57 which project from the bullet jacket base 15 into the interior 13 in the region of the bullet jacket tail section 13 and engage there in the bullet core. Advantageously, an axial engagement length of the at least two pins 57 in the bullet core in the range of 0.2 times to 0.8 times the bullet diameter is given. Furthermore, a diameter of the at least two pins can correspond to approximately 0.05 times to 0.2 times, preferably 0.07 times to 0.015 times, the bullet diameter.

In the exemplary embodiment of FIG. 13, a bullet jacket 3 inner dimension is matched to an outer dimension of a guide band 11' of a core 2 such that an interference fit, preferably a press-fit, is realized. For example, a radial oversize dimension measured perpendicular to the longitudinal direction of the bullet is in the range of 0.0001 mm to preferably 0.1 mm, more preferably in the range of 0.001 mm to 0.01 mm. It has been found that by means of the interference fit, a frictional/force-locking anti-rotation structure can be realized between the bullet jacket and the bullet core, which increases a spin force transmission and thus improves the precision of the bullet. For example, the bullet core, which may be made of lead, hardened steel or tungsten carbide, is inserted into the bullet jacket by a pressing process and pressed together with the jacket. With the bullet according to the invention, $S_a$-values of less than 30 mm, preferably less than 20 mm or even less than 15 mm, can be achieved. The interference fit can be achieved, for example, by separate manufacture of the bullet core and bullet jacket.

In another exemplary embodiment of the present invention, the bullet of FIG. 13 is mounted under temperature treatment. For example, the preferably oversized bullet core is mounted with the bullet jacket under temperature cooling. Alternatively or additionaly, the preferably undersized bullet jacket may be mounted with the bullet core under temperature heating. It has been found that by means of the temperature treatment, on the one hand, the mounting of the bullet according to the invention is facilitated and, on the other hand, the radial interference meanwhile bullet core and bullet jacket can be reinforced, thus enhancing the inventive effect of improved spin force transmission and increased precision of the bullet. When the temperatures of the bullet core and bullet jacket are equalized, i.e., when the bullet core is continuously heated and/or when the bullet jacket is continuously cooled, the frictional/force-locking anti-rotation structure between the bullet jacket and bullet core is then realized.

The features disclosed in the foregoing description, figures, and claims may be significant, both individually and in any combination, for the realization of the invention in the various embodiments.

The invention claimed is:

1. A bullet comprising:

a bullet core with a bow-side section, a tail-side section with a bullet base, and a guide band lying in between the bow-side section and the tail-side section, and a bullet jacket completely surrounding the bullet core, wherein, a profiling is provided in a region of the tail end of the bullet core axially offset from the guide band and/or in the region of a tail end face of the bullet core base and/or in the region of the bullet core bow axially offset from the guide band, wherein the bullet jacket has an inside surface profiling complementary in shape in shape of the profiling of the bullet core such that an anti-rotation structure is formed between the bullet jacket and the bullet core such that the profiling provided on the bullet core and the profiling provided on the inside surface of the bullet jacket comprise latching elements, and wherein a depth in the longitudinal direction of the bullet of a latching element at the bullet base lies in the range from 1/10 mm to 10/10 mm, and/or a radial dimension substantially perpendicular to the longitudinal direction of the bullet of a latching element at the circumference of the bullet lies in the range from 20% to 100% of the diameter of the bullet base and/or lies in the range from 5% to 50% of a wall thickness of the jacket of the bullet.

2. The bullet according to claim 1, wherein the latching elements have a cross, star or polygonal shape.

3. A bullet comprising a bullet jacket with an inner surface and a bullet core arranged inside the bullet jacket with a guide band for guiding the bullet core in the bullet jacket, wherein an outer surface of the guide band at least partially lies against the bullet jacket inner surface, wherein at least one of the bullet jacket inner surface and guide band outer surface lying against each other has, at least in some areas, a roughness in the range from 0.0005 mm to preferably 0.5 mm in order to form an anti-rotation structure between the bullet jacket and the bullet core.

4. The bullet according to claim 3, characterized in that both the bullet jacket inner surface and the outer surface of the guide band have, at least in some areas, a roughness in the range from 0.0005 mm to 0.5 mm.

5. the bullet according to claim 3, wherein the bullet jacket is formed from a metal strip which, at least in some areas, has a roughness in the range from 0.005 mm to preferably 0.05 mm.

6. A bullet comprising a bullet jacket and a bullet core arranged inside the bullet jacket with a guide band for guiding the bullet core in the bullet jacket, wherein a bullet jacket inner dimension is matched to a guide band outer dimension in such a way that an interference fit is realized, wherein a bullet jacket inner surface and/or a guide band outer surface are/is profied in such a way that a leakage flow of a fluid accumulating in the bullet is enabled, and wherein the bullet core has a through bore for the leakage flow, and/or the bullet core is shaped in such a way that at least one guide band outer surface region formed substantially along the complete longitudinal extension of the bullet core is free from contact with the bullet jacket inner surface.

7. A bullet comprising a bullet jacket and a bullet core arranged inside the bullet jacket with a guide band for guiding the bullet core in the bullet jacket, wherein, in the region of the guide band on the bullet jacket and/or the bullet core, a solidification fluid and/or an additive is applied that increases the coefficient of friction between the bullet jacket and the bullet core, which forms an anti-rotation structure between the bullet jacket and the bullet core, wherein an amount of the solidification fluid is in the range of 2 μl to 6 μl.

8. A bullet comprising:

a bullet core with a bow-side section, a tail-side section with a bullet base, and a guide band lying in between the bow-side section and the tail-side section, and a bullet jacket completely surrounding the bullet core, wherein the bullet core is pinned with respect to the bullet jacket in the tail region of the bullet, wherein in particular the bullet base having at least two locking pins which project into at least two openings made in the bullet core base end face, wherein in particular the at least two locking pins project into the bullet core by at least 0.2 times to 0.8 times the bullet diameter and/or a diameter of the at least two locking pins corresponds to 0.05 times to 0.2 times the bullet diameter.

9. A bullet comprising:

a bullet core with a bow-side section, a tail-side section with a bullet base, and a guide band lying in between the bow-side section and the tail-side section, and a bullet jacket completely surrounding the bullet core, wherein, a profiling is provided in a region of the tail end of the bullet core axially offset from the guide band and/or in the region of a tail end face of the bullet core base and/or in the region of the bullet core bow axially offset from the guide band, wherein the bullet jacket has an inside surface profiling complementary in shape in shape to the profiling of the bullet core such that an anti-rotation structure is formed between the bullet jacket and the bullet core, and wherein the tail region of the bullet jacket is designed to be deformation-soft in such a way that a firing pressure occurring when the bullet is fired deforms the tail region of the bullet jacket at least in sections in such a way that the it adapts to the bullet core in order to form or reinforce, an anti-rotation structure between the bullet jacket and the bullet core.

10. A bullet comprising:

a bullet core with a bow-side section, a tail-side section with a bullet base, and a guide band lying in between the bow-side section and the tail-side section, and a bullet jacket completely surrounding the bullet core, wherein, a profiling is provided in a region of the tail end of the bullet core axially offset from the guide band and/or in the region of a tail end face of the bullet core base and/or in the region of the bullet core bow axially offset from the guide band, wherein the bullet jacket has an inside surface profiling complementary in shape in shape to the profiling of the bullet core such that an anti-rotation structure is formed between the bullet jacket and the bullet core, and wherein the bullet core is joined to the bullet jacket by a friction welding, diffusion welding or spot welding process.

11. A bullet comprising:

a bullet core with a bow-side section, a tail-side section with a bullet base, and a guide band lying in between the bow-side section and the tail-side section, and a bullet jacket completely surrounding the bullet core, wherein, a profiling is provided in a region of the tail end of the bullet core axially offset from the guide band and/or in the region of a tail end face of the bullet core base and/or in the region of the bullet core bow axially offset from the guide band, wherein the bullet jacket has an inside surface profiling complementary in shape in shape to the profiling of the bullet core such that an anti-rotation structure is formed between the bullet jacket and the bullet core, wherein the bullet jacket inner surface and the bullet core outer surface are form-locking engaged with each other by means of a repeating protrusion-recess structure in such a way that a relative rotational mobility between bullet jacket and bullet core is prevented, wherein the protrusion-recess structure comprises at least two protrusions on at least one of the bullet jacket inner surface and the outer surface of the bullet jacket and at least two recesses on at least the other of the bullet jacket inner surface and the outer surface of the bullet core, wherein the protrusions and the recesses have a radial extent of at least 1/20 and at most 1/5 of the bullet core diameter.

12. The bullet according to claim 1, wherein the anti-rotation structure allows relative axial mobility between the bullet jacket and the bullet core.

13. A method for rotationally securing a bullet core with respect to a bullet jacket of a bullet according to claim 1, in which at least two locking pins are inserted from the outside into a tail-side bullet base in such a way that the at least two locking pins extend through a bullet jacket end face forming the bullet base and a bullet core base end face facing the bullet jacket end face in order to form an anti-rotation structure.

14. The method according to claim 13, in which, before the insertion of the at least two locking pins in the bullet base, a bore is made in each case for the locking pins, in particular an inside diameter of the bores being dimensioned smaller than an outside diameter of the locking pins and/or the locking pins being pressed in the bores, in particular having a radial oversize with respect to the bores.

15. The bullet according to claim 6, wherein the bullet is manufactured by providing a bullet core inside a bullet jacket, the bullet core having a guide band outer dimension radially oversized with respect to an inner dimension of the bullet jacket, the radial oversize being in the range from 0.0001 mm to 0.1 mm, and forming an interference fit between the bullet core and the bullet jacket.

16. The according to claim 1, wherein the guide band is free of any profiling.

17. The bullet according to claim 15, wherein the radial oversize is in the range from 0.001 mm to 0.01 mm.

18. The bullet according to claim 6, wherein the bullet core is mounted under temperature cooling and/or the bullet jacket and bullet core are mounted under temperature heating.

19. The bullet according to claim 7, wherein the solification fluid is a precipitable solution selected from synthetic oil, biltumen, olive oil, sugar containing liquid or adhesive.

* * * * *